US007967218B2

(12) United States Patent
Alles

(10) Patent No.: US 7,967,218 B2
(45) Date of Patent: Jun. 28, 2011

(54) METHOD FOR CONTROLLING A MULTI-ZONE FORCED AIR HVAC SYSTEM TO REDUCE ENERGY USE

(75) Inventor: Harold Gene Alles, Lake Oswego, OR (US)

(73) Assignee: Home Comfort Zones, Beaverton, OR (US)

( * ) Notice: Subject to any disclaimer, the term of this patent is extended or adjusted under 35 U.S.C. 154(b) by 434 days.

(21) Appl. No.: 12/257,181

(22) Filed: Oct. 23, 2008

(65) Prior Publication Data

US 2010/0102135 A1 Apr. 29, 2010

(51) Int. Cl.
*F24F 3/00* (2006.01)

(52) U.S. Cl. ..... 236/1 B; 165/212; 165/237; 700/277

(58) Field of Classification Search ..... 236/1 B, 236/49.3; 165/208, 209, 212, 237; 700/277
See application file for complete search history.

(56) References Cited

U.S. PATENT DOCUMENTS

| | | | | |
|---|---|---|---|---|
| 6,865,449 | B2 * | 3/2005 | Dudley | 700/276 |
| 6,983,889 | B2 * | 1/2006 | Alles | 236/49.1 |
| 6,997,390 | B2 * | 2/2006 | Alles | 236/49.4 |
| 7,062,830 | B2 * | 6/2006 | Alles | 29/401.1 |
| 7,775,448 | B2 * | 8/2010 | Votaw et al. | 236/1 B |
| 7,789,317 | B2 * | 9/2010 | Votaw et al. | 236/1 B |

* cited by examiner

*Primary Examiner* — Marc E Norman

(57) ABSTRACT

In a multi-zone control system for central forced air HVAC systems where the minimum conditioned airflow produced by the HVAC equipment significantly exceeds the airflow capacity to many of the zones, the invention is an energy saving method for choosing non-calling zones to receive excess airflow in. When satisfying calls for conditioning from one or a few zones, excess conditioned airflow is directed to non-calling zones. The method chooses occupied non-calling zones using a priority that provides comfort, and chooses unoccupied non-calling zones using a different priority that provides energy savings. Limits are provided for each zone to prevent excessive over conditioning in non-calling zones.

8 Claims, 7 Drawing Sheets

TOUT = 50°

100

Prior Art Method

| Room | T° | Units |
|---|---|---|
| 1 | 70.0° | 49 |
| 2 | 64.5° | 5 |
| 3 | 64.5° | 17 |
| 4 | 64.5° | 27 |

Improved Method

| Room | T° | Units |
|---|---|---|
| 1 | 70.0° | 40 |
| 2 | 68.4° | 40 |
| 3 | 59.5° | 0 |
| 4 | 55.5° | 0 |

Energy Reduction = 18.4%

TOUT = 50°

100

Prior Art Method

| Room | T° | Units |
|---|---|---|
| 1 | 64.9° | 15 |
| 2 | 70.0° | 48 |
| 3 | 64.9° | 6 |
| 4 | 64.9° | 27 |

Improved Method

| Room | T° | Units |
|---|---|---|
| 1 | 65.9° | 19 |
| 2 | 70.0° | 44 |
| 3 | 65.8° | 25 |
| 4 | 59.8° | 0 |

Energy Reduction = 8.3%

Prior Art Method
T:OUT = 50°
28.6 Units of Heat

Improved Method
T:OUT = 50°
20.7 Units of Heat
27.6% Reduction

Prior Art Method
T:OUT = 50°
29.2 Units of Heat

Improved Method
T:OUT = 50°
25.1 Units of Heat
14.0% Reduction

Prior Art Method
T:OUT = 50°
27.3 Units of Heat

Improved Method
T:OUT = 50°
20.2 Units of Heat
26.0% Reduction

METHOD FOR CONTROLLING A MULTI-ZONE FORCED AIR HVAC SYSTEM TO REDUCE ENERGY USE

BACKGROUND OF THE INVENTION

1. Technical Field of the Invention

This invention relates generally to multi-zone forced-air HVAC systems, and specifically to control methods for reducing conditioning and energy consumption.

2. Background Art

Most zone control systems for residential forced-air HVAC systems have a small number of zones in combination with HVAC equipment that has fixed capacity or variable capacity over a limited range or discrete steps of capacity. Simple zone control systems have a convention thermostat for each zone. Each zone has and airflow control damper that is opened or closed by signals from the thermostat for that zone. The calls for conditioning from each thermostat are combined using a logical OR function. The conditioning equipment runs when one or more thermostats make a call for conditioning. When a thermostat calls for conditioning, the damper for that zone is open. When the zone thermostat is not calling for conditioning, the damper for that zone is closed. Each zone operates independently without knowledge of the conditioning of the other zones.

One problem with simple zone control is that the amount of conditioned airflow needed depends on the number of zones calling for conditioning. For example, in a system with four equal zones, each zone might be capable of receiving only 25% of the total capacity. If the HVAC equipment has fixed capacity and only one zone calls for conditioning, 75% of the airflow is excess capacity. Various strategies are used in the prior art for dealing with this excess airflow capacity.

A simple strategy is to oversize the duct work to each zone so it can receive 100% of the airflow produced by the HVAC equipment. However, the extra ducting is expensive to install and requires space that may not be available. This is usually not practical for retrofit. In addition, when multiple zones call for conditioning, the airflow velocity to each zone is reduced, so the conditioned air may not mix properly with the unconditioned air in the zones. This may produce warm and cool areas within the zones.

Another strategy for managing the excess airflow is to use a controllable bypass duct to shunt supply airflow directly to the return airflow. The bypass typically opens automatically as the supply pressure increases, providing a path for some of the excess conditioned airflow. U.S. Pat. No. 5,249,596 issued Oct. 5, 1993 to Hickenlooper, III et al. describes a bypass damper for use in such zone control systems.

A significant problem with using a bypass is the return air becomes heated or cooled. When in heating mode, excessive bypass airflow can heat the return air temperature above 85°. This exceeds the recommend operating conditions for most residential HVAC equipment, voiding the manufacturer's warranty. When in cooling mode, excessive bypass can reduce the return air temperature sufficiently to freeze the evaporator coil. To prevent excessive return air temperatures in most HVAC systems, the maximum bypass airflow must be less than about 20% of the total conditioned airflow.

Another problem with using a bypass is that it shifts the effective operating temperature of the heat exchange process. This usually reduces the energy efficiency of the equipment and can reduce equipment lifetime.

Another strategy for dealing with excess conditioned airflow is to only partially close the dampers of at least some of the zones that are not calling for conditioning. In some systems, the dampers have mechanical stops that must be set and adjusted during the installation process or in a follow up service call. In other system, the damper positions are set dynamically by a control process. U.S. Pat. No. 5,829,674 issued Nov. 3, 1998 to Vanostrand, et al. describes a multi-zone control system that uses modulating dampers. These control systems are designed primarily for temperature balancing between zones to maximize comfort. The control methods are not optimized for energy savings.

Another strategy for dealing will excess conditioned airflow is to use HVAC equipment that has variable capacity. In these systems, the total needs of all the zones are considered when setting the output capacity of the HVAC equipment. Some variable capacity HVAC equipment provides two discrete stages where the first-stage produces 60% to 70% of the conditioned airflow as the second-stage. Other equipment can be adjusted continuously from about 30% to 100% based on the required airflow for the zones that require conditioning. U.S. Pat. No. 5,863,246 issued Jan. 26, 1999 to Bujak, Jr. describes a zone control system where the conditioning capacity of the HVAC equipment is adjusted to match the needs of the zones calling for conditioning.

Any zone system should improve the temperature control in a building. More zones provide better temperature control. Zone systems can potentially reduce the energy used to condition a building, but the energy savings depends on the details for the building, the zone system, and how the occupants set the zone temperatures. Some zone systems actually use more energy because the excess airflow is inefficiently managed.

Zone systems can save energy by selectively conditioning areas based on occupancy and activity. Areas that are occupied are conditioned only as much as needed, and areas that are unoccupied are conditioned as little as possible. Energy savings depends on the zone areas matching occupancy areas and the ability of occupants to easily set temperatures that match their occupancy patterns. In addition, settings that save energy when an area is unoccupied should not affect the comfort of that area when occupied.

In a typical zone control system for use in single family homes, a zone includes several rooms. The airflows to all rooms in the zone are controlled by one thermostat. To provide good temperature control, all rooms in the zone must have good thermal coupling with the zone thermostat. Zones must be related to the geometry of the home rather than the use of the rooms in the zone. For example, a two-zone system typically divides a home into a living area and a sleeping area or an upstairs area and a downstairs area. Using different temperature settings for each zone for different times of the day can reduce the energy used for conditioning. However, the actual occupancy pattern may not match the zone organization. For example, one bedroom might be used as a home office. Or one bedroom may be a nursery occupied full time by an infant. School children may use their bedroom in the afternoon for homework or play, or use it all day in the summer. If one room in the zone is occupied, then the entire zone must be conditioned for occupancy. Likewise one person may use one room of the living space early in the morning and a different person use another room in the living space late at night. With only two zones, it is likely that at least one room in each zone is occupied most of the time. There is little opportunity to reduce the conditioning to save energy.

The best opportunity for energy savings while maximizing comfort is to make every room a separate zone, providing a temperature sensor, temperature settings, and airflow control for every area that has a supply vent and a door or different thermal environment. An average 2500 square ft home has 10-15 separate rooms and areas with different thermal environments, so a 10-15 zone system should be used. Such a multi-zone control system for residential use is disclosed in U.S. Pat. No. 6,786,473 issued Sep. 7, 2004 to Alles, U.S. Pat. No. 6,893,889 issued Jan. 10, 2004 to Alles, U.S. Pat. No. 6,997,390 issued Feb. 14, 2006 to Alles, U.S. Pat. No. 7,062,830 issued Jun. 20, 2006 to Alles, U.S. Pat. No. 7,162,884 issued Jan. 16, 2007 to Alles, U.S. Pat. No. 7,188,779 issued Mar. 13, 2007 to Alles, and U.S. Pat. No. 7,392,661 issued Jul. 1, 2008 to Alles. These patents describe various aspects of a HVAC zone control system that uses inflatable bladders and various control methods. This system is designed for retrofit and to use the existing HVAC systems in residential single family homes. Homes larger than 2500 sq ft typically have 12-30 vents, each with an airflow capacity only a small fraction of that supplied by the HVAC equipment. Therefore any time the HVAC equipment is run, a minimum number of vents must be open to provide sufficient airflow capacity to allow the HVAC equipment to operate efficiently. Even if a single room calls for conditioning, the HVAC equipment should be run to provide comfort in that room. This means that several rooms that are not calling for conditioning must also be conditioned.

U.S. Pat. No. 7,188,779 issued Mar. 13, 2007 to Alles describes a method for selecting zones to receive a portion of the excess conditioning from among those zones not calling for conditioning. Non-calling zones are incrementally selected for conditioning until total airflow capacity is sufficient to receive the airflow generated by the HVAC equipment. The priority for selecting non-calling zones is primarily based on the zone's nearness to needing conditioning. In the simplest terms, this is determined by the difference between the zone's temperature and its set point. The unconditioned and non-calling zone with its temperature closest to its set point is the next zone selected for conditioning.

This method produces good results for comfort, but may use more energy for conditioning than necessary when many zones are unoccupied. If many zones are set for minimum conditioning because they are unoccupied, the excess conditioned air tends to be distributed to all of the non-calling zones such that their temperatures are all about the same. In most cases, energy can be saved by conditioning only a specific subset of the non-calling zones while providing little or no conditioning to other non-calling zones. As a result, the temperature difference between some non-calling zones can be quite large. However, less total conditioning, and therefore less energy is needed to condition the occupied zones to their set temperatures.

OBJECT OF THIS INVENTION

The object of this invention is to provide an improved method for selecting non-calling zones to receive excess conditioning in a multi-zone HVAC system such that the improved method reduces the need for conditioning, thereby saving energy.

SUMMARY

The invention is an energy saving method for controlling multi-zone forced air HVAC systems where the minimum conditioned airflow produced by the HVAC equipment significantly exceeds the airflow capacity of many of the zones. When satisfying calls for conditioning from one or a few zones, excess conditioned airflow is directed to non-calling zones. The method selects non-calling occupied zones based on a priority that provides comfort and selects non-calling unoccupied zones based on a priority that provides energy savings. Limits are provided for each zone to prevent excessive conditioning.

BRIEF DESCRIPTION OF THE DRAWINGS

The invention will be understood more fully from the detailed description given below and from the accompanying drawings of the methods of the invention which, however, should not be taken to limit the invention to the specific methods described, but are for explanation and understanding only.

DETAILED DESCRIPTION

Figure 1:
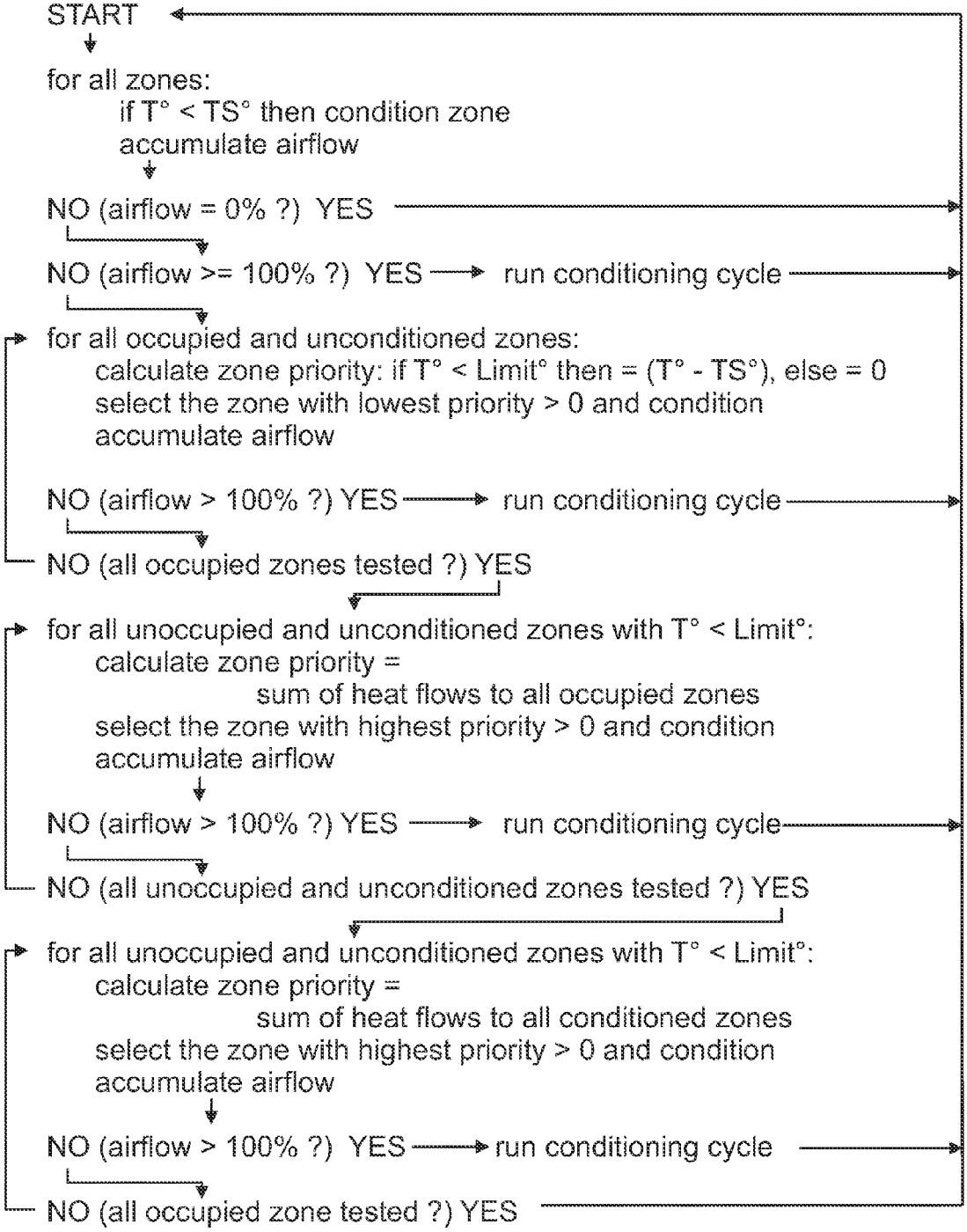
FIG. 1 is a logic flow diagram of the improved method for selecting non-calling zones for excess conditioning.

FIG. 1 is a logic flow diagram of the improved method for selecting non-calling zones to receive excess conditioned airflow. The method makes decisions based on the occupancy of each zone. Each zone is either occupied or unoccupied so the total of the occupied zones and unoccupied zones equals the total number of zones in the HVAC system.

The set temperature of a zone can be used to determine its occupancy. For example if the heating set temperature is less than a preset heating threshold such as 55°, it is reasonable to assume the zone is unoccupied. Likewise if the cooling set temperature is greater than a preset cooling temperature such as 90°, it is reasonable to assume the zone is unoccupied.

Other ways to determine occupancy can be used with the improved method. For example the temperature sensor for each zone can have a switch or button for communicating the occupied or unoccupied state to the zone control system. The occupant is responsible for setting the state. As another example, at the human interface where the set temperature schedules for the zones are entered, an explicit "unoccupied" selection can be provided. This selection is made for the schedule times when the zone is unoccupied. When the zone is scheduled to be occupied, a specific set temperature is selected. Various motion sensors are commercially available that can automatically detect and communicate occupancy. These may be preferred in some applications.

The first part of the flow diagram in FIG. 1 is similar to the prior art. The temperature T° in each room (occupied or unoccupied) is compared to it current set temperature TS°. The sign of the compare depends on whether heating or cooling. Heating is called if T° is less than the heat TS°. Cooling is called if T° is greater than the cool TS°. A flag is set for each zone calling for conditioning and the airflow percentages for all calling zones are accumulated. After testing all the zones, if the accumulated airflow %=0, then no zones are calling for conditioning and the logic flow is started over.

If the accumulated airflow % is equal to or greater than 100%, then there is no excess conditioned airflow. There is no need to select a non-calling zone, so a conditioning cycle is run.

If at least one zone is calling for conditioning and the accumulated airflow % is less than 100%, then at least one non-calling zone must be selected to receive the excess conditioned airflow. Non-calling occupied zones are considered first. If an occupied zone is close to needing conditioning, then receiving the excess conditioned airflow reduces or eliminates the calls for conditioning from this zone. However, excessive over conditioning can reduce comfort, so a limit temperature is provided.

Non-calling occupied zones are selected one at a time based on the difference between its temperature and its set temperature. If the zone temperature is greater than the conditioning limit, the difference is set to zero. The one non-calling zone selected is the zone with the smallest non-zero difference. Of all the non-calling zones, that zone is closest to needing conditioning. The flag for this zone is set and its airflow added to the accumulated airflow. If the accumulated airflow is equal to or greater than 100%, then a conditioning cycle is run.

If the accumulated airflow is less then 100%, then the non-calling occupied rooms with their flag not set for conditioning are processed again. The next zone closest to needing conditioning is selected, its flag set for conditioning, and its airflow added to the airflow accumulation.

If all available non-calling occupied zones have been selected without the accumulated airflow reaching 100%, then the non-calling unoccupied zones are processed. A selection priority is calculated for each unoccupied zone. The priority of a zone is based on the total heat flow between all occupied zones and that unoccupied zone. The unoccupied zone that has the largest heat flow with occupied rooms is selected to receive excess conditioned airflow. Determining the heat flow requires the heat flow coefficients between adjacent rooms. These can be calculated using a standard process called "Manual J" provided by the ACCA. They can also be approximated from a floor plan or by inspecting the home. The heat flow between two zones is the temperature difference between the two zones times the heat flow coefficient between the two zones.

The priority of each unoccupied and unconditioned zone is calculated, provided the zone temperature is less than the limit temperature. The heat flow between the unoccupied zone and all occupied zones is calculated by summing the product of the temperate difference between the unoccupied zone and each occupied zone and the corresponding heat flow coefficient. Temperature differences less than one degree are rounded up to one degree to ensure each heat flow coefficient has consistent influence on the calculated priority. The one unoccupied zone with the highest priority is selected for the excess conditioned air and its flag is set. Its airflow is added to the accumulated airflow. If the accumulated airflow is 100% or more, the conditioning cycle is run.

If the accumulated airflow is less than 100%, the remaining unoccupied and unconditioned zones are processed again to find the next zone to receive excess conditioning. This is repeated until there are no unoccupied zones with heat flow to the occupied zones.

The method finally considers the unoccupied zones that are most thermally isolated from the occupied zones, provided the zone temperature is less than the limit temperature. All heat flow coefficients between these unoccupied zones and the occupied zones are equal to zero. However, there are non-zero heat flow coefficients between unoccupied and unconditioned zones and unoccupied zones that are receiving excess conditioning. The priority of each unoccupied and unconditioned zone is calculated. The heat flow between the unoccupied zone and all conditioned zones (the ones with their flag set) is calculated by summing the product of the temperate difference between the unoccupied zone and each conditioned zone and the corresponding heat flow coefficient. Temperature differences less than one degree are rounded up to one degree to ensure each heat flow coefficient has consistent influence on the calculated priority. The one unoccupied zone with the highest priority is selected for the excess conditioned air low and its flag is set. Its airflow is added to the accumulated airflow. If the accumulated airflow is 100% or more, the conditioning cycle is run.

If after all zones are processed, the accumulated airflow is less than 100%, there is no acceptable way to have sufficient airflow, so a conditioning cycle is not run. This can happen when most zones are conditioned to their limit while one or more calling zones can not be adequately conditioned because of insufficient airflow. The method will continue to process the zones while temperatures equalize until conditioning can be run.

In summery, the improved method selects non-calling unoccupied zones to receive excess conditioning such that the zones thermally coupled to the occupied zones receive the most conditioning. Zones least thermally coupled to the occupied zones receive the least conditioning.

Figure 2:
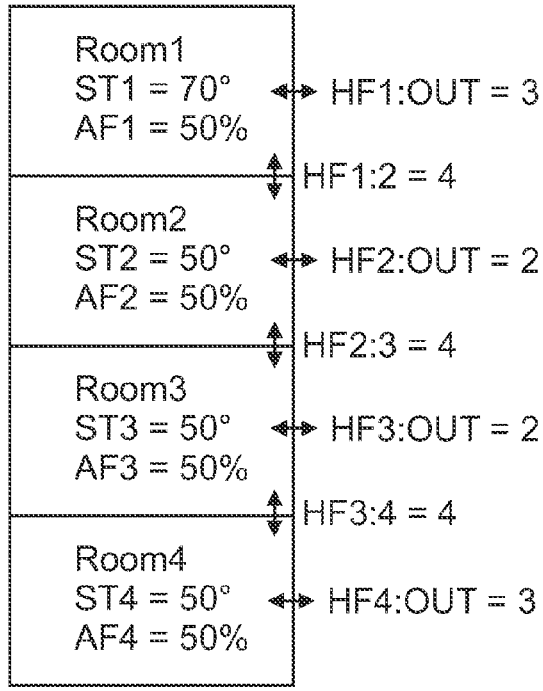
FIG. 2 compares the relative energy efficiency of methods for selecting non-calling zones in an idealized building where only an end zone is occupied.

FIG. 2 compares the relative energy efficiency for two methods of selecting non-calling zones in an idealized home 100. Each parameter has a symbolic representation and a specific value for this example. The representation is general and the example is provided to facilitate understanding.

Home 100 has 4 zones labeled Room1 through Room4. Each zone has a measured temperature referred to as T1 through T4. Each zone has a set temperature referred to as ST1 through ST4. The set temperature is used to identify occupied and unoccupied zones. Zones with a ST at or below a threshold temperature are treated as unoccupied. Room1 is occupied with ST1=70°, and Room2 through Room4 are unoccupied with ST2=ST3=ST4=50°. The outside temperature is referred to as TOUT=50°, so this specific example is for the HVAC equipment providing conditioned airflow for heating.

The heat flow coefficient from each zone to the outside is referred to as HF1:OUT=HF4:OUT=3 and HF2:OUT=HF3:OUT=2. This heat flow coefficient is the total heat flow per degree difference between the inside and outside so that the heat flow between Room1 and the outside is (T1−TOUT) *HF1:OUT.

The heat flow coefficient between adjacent zones is represented by HF1:2=HF2:3=HF3:4=4. For example the total heat flow between Room1 and Room2 is (T1−T2)* HF1:2.

Each zone can receive a portion of the conditioned airflow produced by the HVAC equipment referred to as AF1 through AF4. The sum of the conditioned airflows to each zone must be significantly greater then the conditioned airflow produced by the HVAC equipment. With AF1=AF2=AF3=AF4=50%, at least two zones must be conditioned when the HVAC equipment operates. If 3 zones receive conditioning, the airflow to each conditioned zone is 33% of the HVAC equipment capacity. If 4 zones receive conditioning, the airflow to each zone is 25% of the HVAC equipment capacity.

The individual symbolic equations representing the equilibrium heat flow for each zone are straightforward. At equilibrium, sum of the heat flows into each zone must be zero. For example consider Room2:

$$(T2-T\text{out})*HF2:\text{OUT}+(T2-T1)*\text{HF}1:2+(T2-T3)*\text{HF}2:3=0$$

Solving the symbolic equations for determining the equilibrium temperatures while using conditioning are quite complex. The benefit of the improved method is best understood and appreciated by using numerical examples and a simulator to calculate the heat flows and equilibrium temperatures. Those skilled in the art can use a commercially available simulator or can construct a simulator using a spreadsheet model. The results presented in this disclosure were calculated using Microsoft Excel spreadsheets and Visual Basic programs.

For the example shown in FIG. 2, one non-calling zone must be conditioned each time the occupied zone requires conditioning to maintain its set temperature. All of the non-calling zones are also unoccupied. The prior art method for selecting the non-calling zone prioritizes selection based on the difference between the zone's measured temperature and the zone's set temperature. The non-calling zone with the smallest temperature difference is selected. Since the set temperatures are the same for all non-calling zones, the zones are selected such that their equilibrium temperatures are about equal. The simulation finds T2=T3=T4~64.5°. After reaching equilibrium, it takes 49 units of heating per unit of time to maintain Room1 at 70°. Therefore 49 equal units of heating are distributed among the three unoccupied zones. Room2 receives 5 units, Room3 receives 17 units, and Room 4 receives 27 units. The zone most thermally isolated from the occupied zone receives the most conditioning. The zone most thermally coupled to the occupied zone (Room2) receives the least conditioning because it is partially conditioned by heat flow from the occupied zone (Room1).

The improved method for selecting the non-calling unoccupied zone for conditioning prioritizes the selection based on the heat flow between the occupied zone and the non-calling unoccupied zone. The non-calling unoccupied zone with the largest heat flow from the occupied zone is selected. The heat flow is the temperature difference multiplied by the heat flow coefficient between the zones. For the example of FIG. 2, only Room2 is selected. Room3 and Room4 receive none of the excess conditioned airflow. Using the improved method, 40 units of heating are needed to maintain Room1 at 70°. Therefore Room2 also receives 40 units of heating. Since all of the excess heating goes to Room2, its temperature will be as high as possible. Therefore the heat flow from Room1 to Room2 is as small as possible. Although Room2 receives the same amount of heat as Room1, its temperature is less because the heat flows to Room3 and the outside are greater than the heat flow from Room1. The equilibrium temperatures for the unoccupied zones are T2~68.4°, T3~59.5°, and T4~55.5°. The improved method for selecting reduced the needed heat from 49 units to 40 units, a reduction of about 18.4%.

Figure 3:
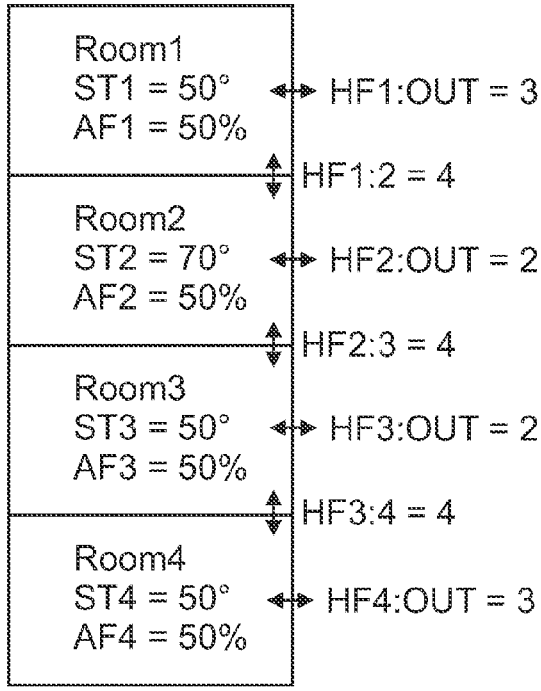
FIG. 3 compares the relative energy efficiency of methods for selecting non-calling zones in an idealized building where only a middle zone is occupied.

FIG. 3 compares the efficiency of home 100 when Room2 is occupied and the other 3 zones are unoccupied. Using the method of the prior art, 48 units of heat are needed to maintain Room2 at 70° and the unoccupied zones reach an equilibrium temperature of about 64.90. Room1 receives 15 units of heat, Room3 receives 6 units, and Room4 receives 27 units. Using the improved method, 44 units of heat are needed to maintain Room2 at 70°. The equilibrium temperatures for the unoccupied zones are T1=T3~65.8° and T4~59.8°. Room1 receives 19 units of heating, Room3 received 25 units, and Room4 received 0 units. The improved method reduced the needed heat from 48 units to 44 units, a reduction of about 8.3%.

Figure 4:
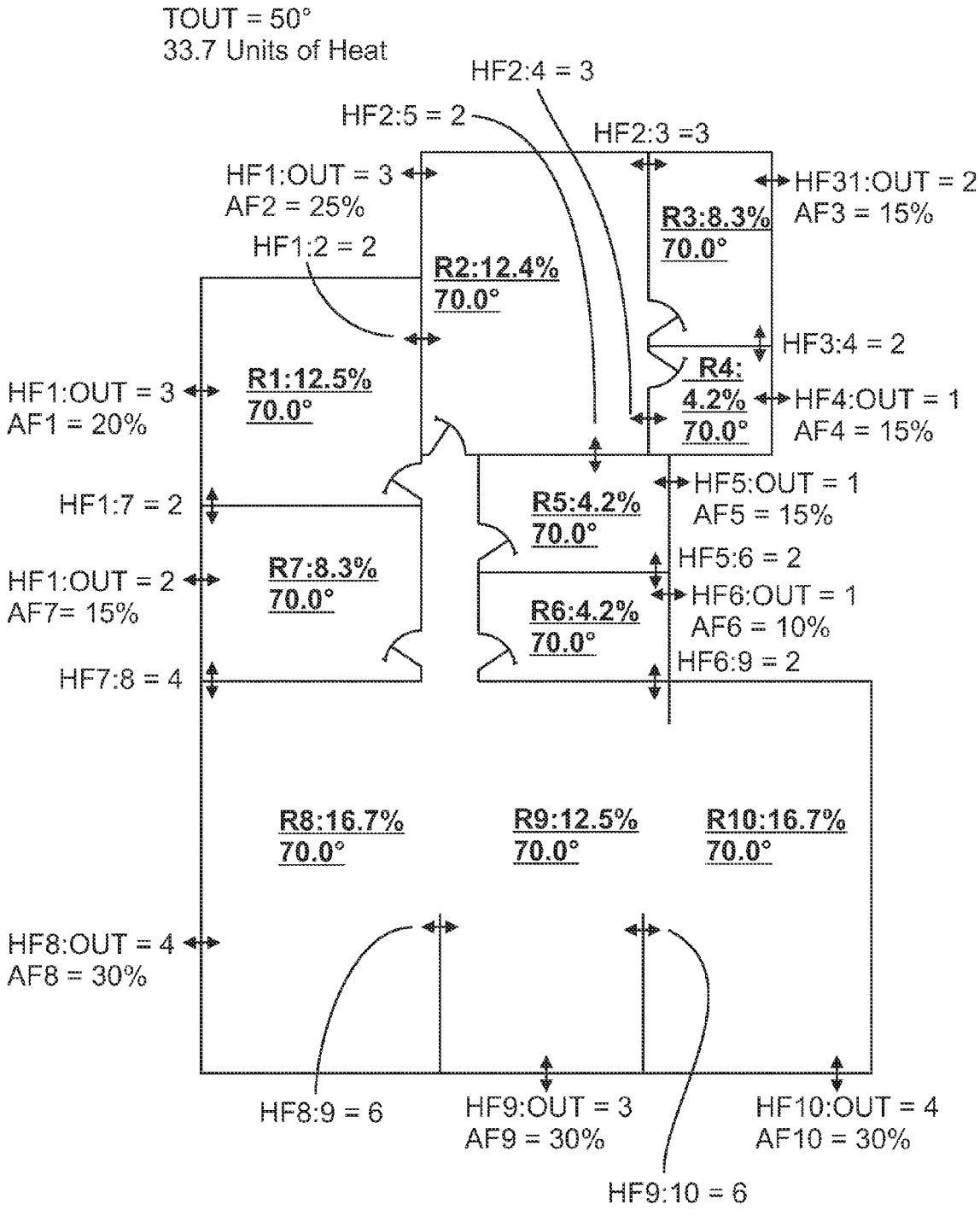
FIG. 4 is a floor plan of a typical home with heat flow and conditioning parameters.

FIG. 4 is a floor plan of a representative small home with 10 zones. Each zone is referred to as R1 through R10. Typically R1, R5, and R7 are bedrooms, R2, R3, and R4 are the master suite, R6 is a bath, R8 is a dining room, R9 is a kitchen, and R10 is a family room. The values for the heat flow coefficients between all zones HF1:2 through HF9:10 and between each zone and the outside HF1:OUT through HF10:OUT are shown. For TOUT=50° and all room occupied with ST=70°, approximately 33.7 units of heat for each simulation time period is needed to maintain 70° in each zone. The percentage of the total heat that each zone receives is shown for each zone. For example, R1:12.5% means zone R1 receives 12.5% of the 33.7 units of heat to maintain its temperature at 70°. For zones that are occupied, the zone name, heat percentage, and zone temperature are in bold type and underlined. All zones in FIG.4 are occupied and all zones have a temperature of 70°.

Figure 5A:
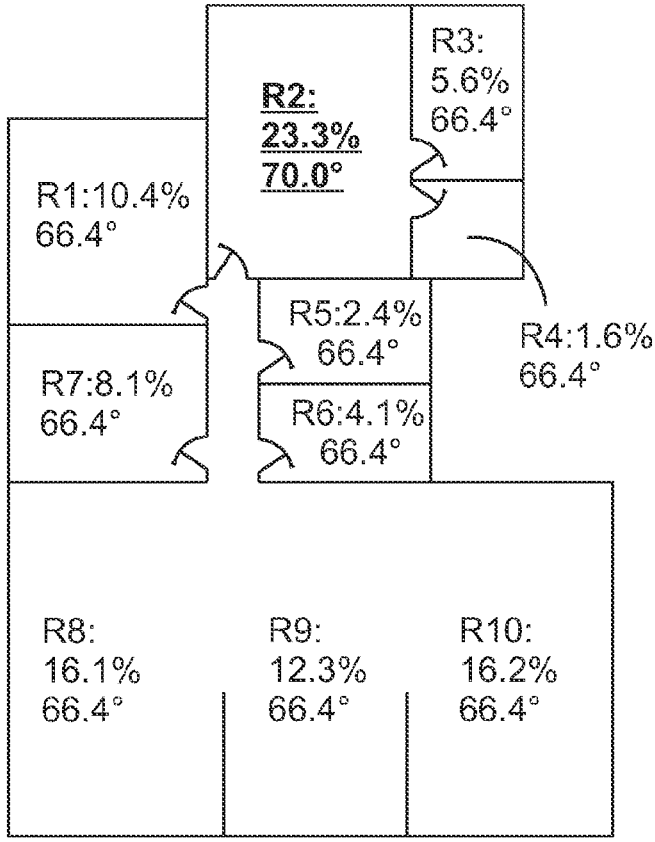
FIG. 5A and FIG. 5B compare the relative energy efficiency of methods for selecting non-calling zones in a typical home where only one zone on the end is occupied.
Figure 5B:
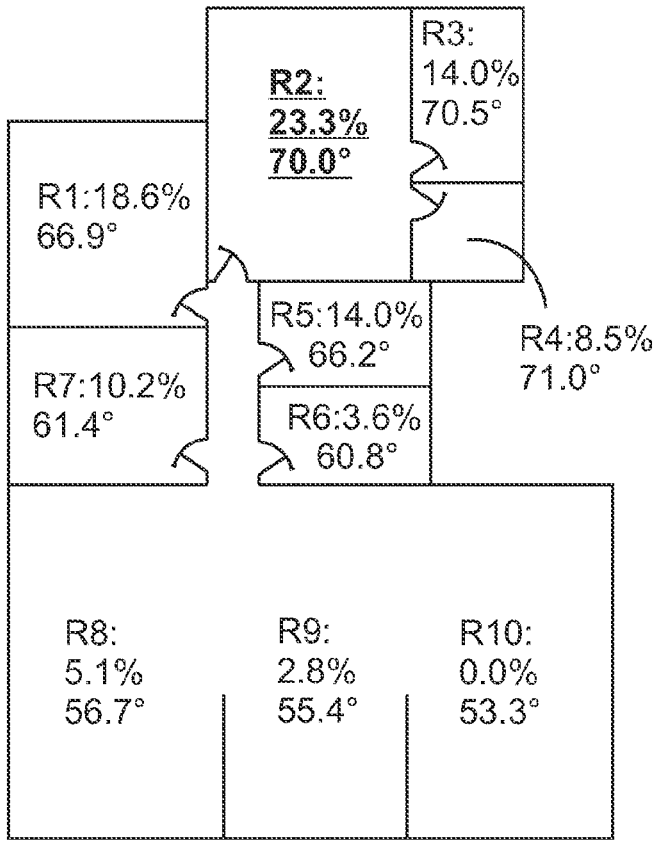

FIG. 5A and FIG. 5B are smaller representations of the home shown in FIG.4. Zone R2 is the only occupied zone with ST=70°. R2 is at an end of the building and thermally isolated from five of the other zones. All other zones are unoccupied with ST=50°. FIG. 5A shows the results of using the method of the prior art to select non-calling zones for conditioning. All unoccupied zones receive heat such that they all reach an equilibrium temperature of about 66.4°.

FIG. 5B shows the results when using the improved method. The total heat to maintain R2 at 70° is 27.6% less when using the improved method. The improved method selects unoccupied zones adjacent to R2 for receiving excess conditioned airflow. Very little excess conditioned airflow is sent to zones thermally isolated from R2. The temperatures of the unoccupied zones range from 53.3° to 71.0°. The limit conditioning temperature is 71°, so zone R4 is selected for excesses airflow whenever its temperature drops below 71°.

Figure 6A:
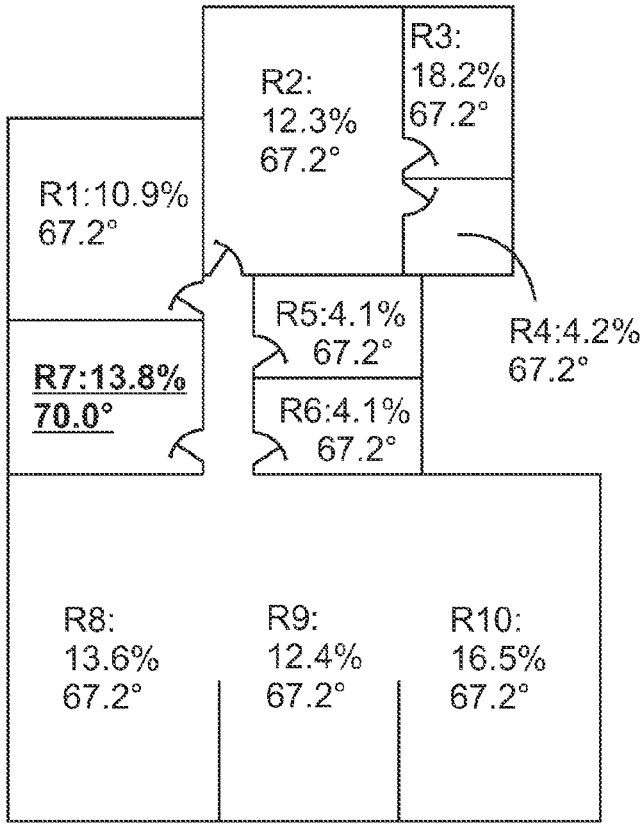
FIG. 6A and FIG. 6B compare the relative energy efficiency of methods for selecting non-calling zones in typical home where only one zone near the middle is occupied.
Figure 6B:
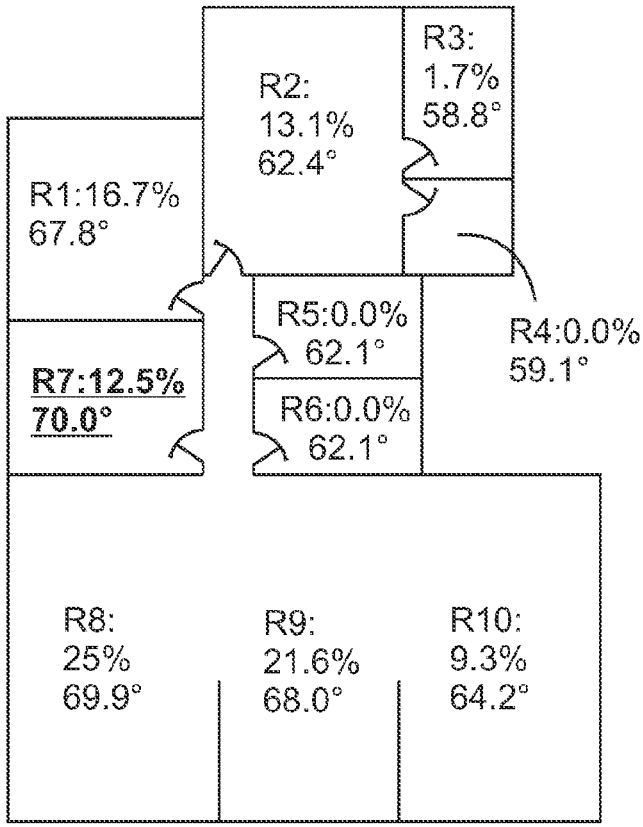

FIG. 6A and FIG. 6B compares the methods when R7 is the only occupied zone. R7 is centrally located in the building with more thermal coupling to the entire home than the example in FIG. 5.

FIG. 6A shows the results using the prior art method. The total heat needed to maintain R7 at 70° is 29.2 units per simulation period. All unoccupied zones receive heat such that they all reach an equilibrium temperature of about 67.2°.

FIG. 6B shows the results when using the improved method. The total heat to maintain R7 at 70° is 14.0% less when using the improved method. The improved method selects unoccupied zones adjacent to R7 for receiving excess conditioned airflow. Very little excess conditioned airflow is sent to zones thermally isolated form R7. The temperatures of the unoccupied zones range from 58.8° to 69.9°. The energy savings is less for this example than for the example of FIG. 5 because R7 is more centrally located and heat flows from R7 to more rooms.

Figure 7A:
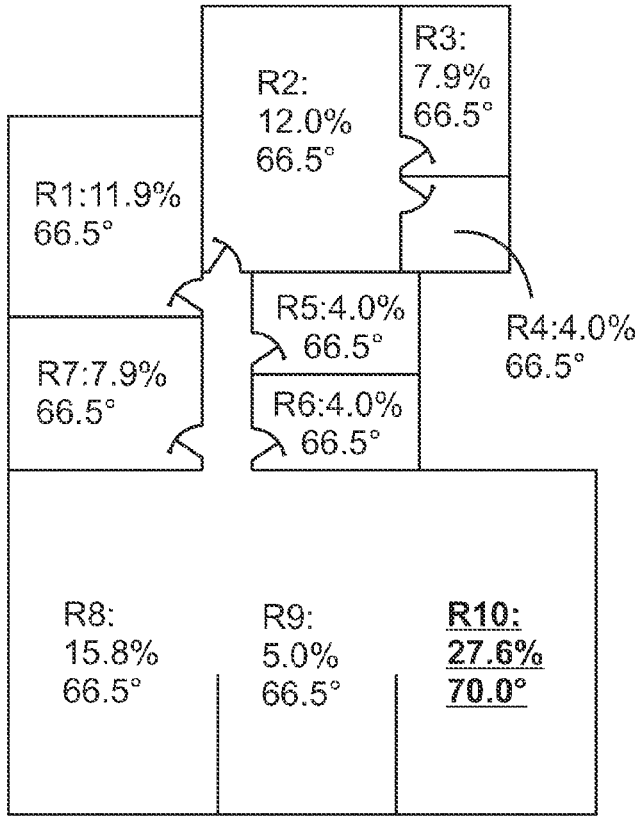
FIG. 7A and FIG. 7B compare the relative energy efficiency of methods for selecting non-calling zones in typical home where only one zone on the opposite end is occupied.
Figure 7B:
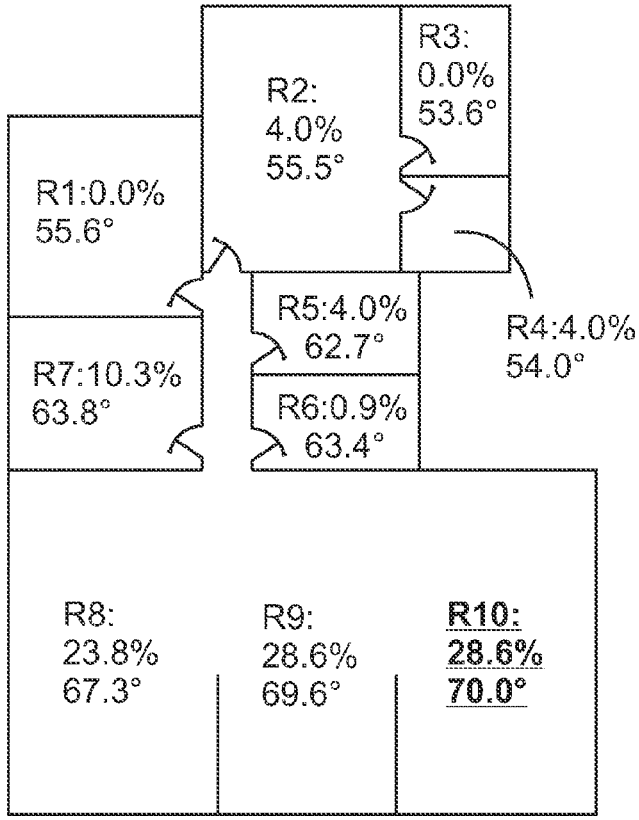

FIG. 7A and FIG. 7B compares the methods when R10 is the only occupied zone. R10 is located at the end of building with thermal coupling to a large open area. FIG. 7A shows the results using the prior art method. All unoccupied zones receive heat such that they reach an equilibrium temperature of about 66.5°.

FIG. 7B shows the results when using the improved method. The total heat to maintain R10 at 70° is 26.0% less when using the improved method. The improved method selects unoccupied zones adjacent to R10 for receiving excess conditioned airflow. Very little excess conditioned airflow is sent to zones thermally isolated form R10. The temperatures of the unoccupied zones range from 53.6° to 69.6°. In this example, zones R1 through R4 are thermally isolated from R10, so they receive very little conditioning.

These examples demonstrate that the improved method for selecting non-calling unoccupied rooms for receiving excess conditioned airflow significantly reduces the conditioning needed to maintain the set temperatures of occupied zones, thereby saving energy. The reductions increase and the savings increase when many zones are unoccupied. Many zones are unoccupied most of the time because homes usually have many more zones than occupants. When every room is controlled as a separate zone, most of the zones are unoccupied most of the time.

The improved method requires knowledge of the heat flow coefficient between adjacent rooms. Approximate values are sufficient for the improved method to make selections that save energy. For example, six values can be used for typical single family homes:

| Name | Value | Description |
|---|---|---|
| None | 0 | The two zones share no walls, floors, or ceilings |
| Very Small | 1 | The ceiling of one zone is the floor of the other zone |
| Small | 1.5 | The two zones share a common wall |
| Medium | 2 | The two zones share a common wall with a door |
| Large | 2.5 | The two zones share a common wall with an open passage |
| Very Large | 3 | The two zones share a large open passage |

These relative values can be easily determined for each pair of zones using floor plans or inspection of the existing building.

Figure 8:
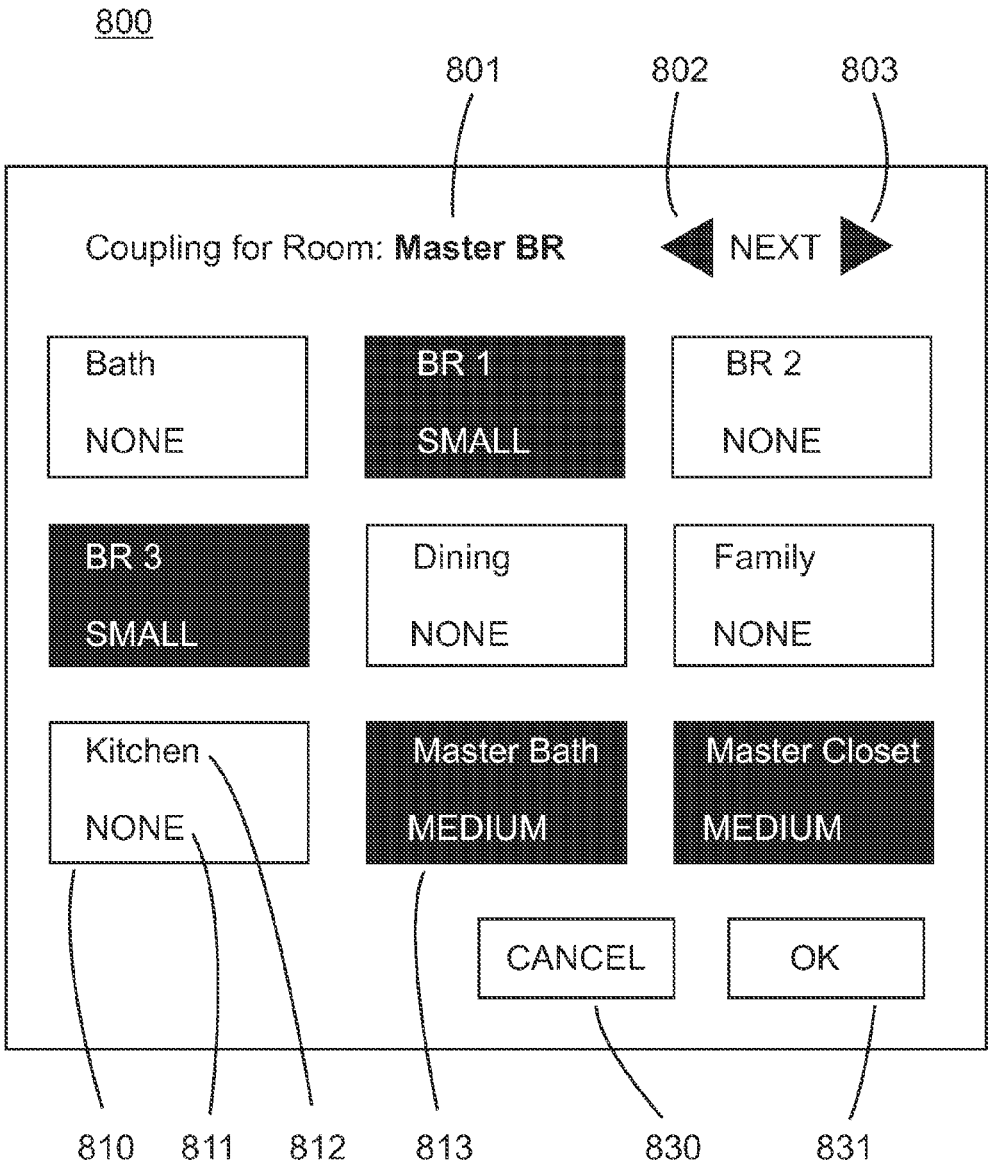
FIG. 8 is a diagram of a touch screen interface for entering heat flow coefficients for each room in a home.

The multi-zone control system patented by Alles and described in the forgoing includes a graphics touch screen for entering information. FIG. 8 shows an example of a human interface using a touch screen 800 for entering the heat flow coefficients for the zones of the home shown in FIG. 4. Typically room names are used in FIG. 8 rather than RI through R10. There is a similar screen for each zone in the building.

The name of the zone is displayed in area 801. Touch areas 802 and 803 are used to scroll forwards or backwards through an alphabetical list of zones to select a specific zone. The screen for each zone has a touch area for each other zone in the home. For example, the touch area for the Kitchen 812 is area 810. The heat flow coefficient between the Master BR 801 and the Kitchen 812 is set to NONE 811. Each time the area associated with a zone is touched, the display increments through the sequence of available values for the heat flow coefficient; for example NONE, VERY SMALL, SMALL, MEDIUM, LARGE, VERY LARGE, NONE . . . as described in the foregoing. When a value other than NONE is selected, the touch area is graphically inverted to make it visually obvious which zones are thermally coupled to the zone 801. The touch area 813 for the Master Bath is touched 3 times to reach the value of MEDIUM and the touch area is graphically inverted. Touching the area three more times changes the display to NONE and the area is not graphically inverted. Touch areas CANCEL 830 and OK 831 are used to navigate to other screens used for other purposes.

CONCLUSION

From the forgoing description, it will be apparent that there has been provided an improved method for selecting non-calling unoccupied zones to receive excess conditioned airflow. The method maintains comfort in the occupied rooms while reducing the energy used. Variation and modification of the described method will undoubtedly suggest themselves to those skilled in the art. Accordingly, the forgoing description should be taken as illustrative and not in a limiting sense.

The various features and examples illustrated in the figures may be modified in many ways, and should not be interpreted as though limited to the specific methods or conditions in which they were explained and shown. Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed:

1. In a control system for forced air HVAC systems, said HVAC system having a source of conditioned airflow of certain amount, said control system controlling said source, said control system having a plurality of control zones, each said zone capable of receiving a portion of said source under control of said control system, each said zone capable of calling for conditioning, said control system sending said portion to each calling zone while said calling continues, said control system capable of selecting non-calling zones to receive excess of said conditioned airflow not sent to said calling zones such that the sum of said portions sent to said calling zones and said portions sent to said non-calling zones is equal to or greater than said certain amount, an energy efficient method for selecting said non-calling zones to receive said excess comprising:

a. providing a conditioning limit for each said zone;

b. determining the occupancy each said zone;

c. providing a comfort method for selecting a non-calling unconditioned and occupied said zone within said conditioning limit for receiving said excess;

d. providing an energy efficient method for selecting a non-calling unconditioned and unoccupied said zone within said conditioning limit for receiving said excess.

2. The method of claim 1 where said energy efficient method selects the said non-calling unconditioned and unoccupied said zone that has the largest heat exchange with occupied said zones.

3. The method of claim 1 where said energy efficient method selects the said non-calling unconditioned and unoccupied said zone that has the largest heat exchange with occupied said zones, and if none are found, selects the said non-calling unconditioned and unoccupied said zone that has the largest said heat exchange with said zones receiving said conditioning.

4. The method of claim 1 where said comfort method selects the said non-calling unconditioned and occupied zone that is nearest the condition for making said call.

5. In a control system for forced air HVAC systems, said HVAC system having a source of conditioned airflow of certain amount, said control system controlling said source, said control system having a plurality of control zones, each said zone capable of receiving a portion of said source under control of said control system, each said zone capable of calling for conditioning, said control system sending said portion to each calling zone while said calling continues, said control system capable of selecting non-calling zones to receive excess of said conditioned airflow not sent to said calling zones such that the sum of said portions sent to said calling zones and said portions sent to said non-calling zones is equal to or greater than said certain amount, an energy efficient method for selecting said non-calling zones to receive said excess comprising:

a. providing a conditioning limit for each said zone;

b. determining the occupancy each said zone;

c. providing a heat flow coefficient between an occupied said zone and an unoccupied said zone;

d. providing a comfort method for selecting a non-calling unconditioned and occupied said zone within said conditioning limit for receiving said excess;

e. providing an energy efficient method for selecting a non-calling unconditioned and unoccupied said zone within said conditioning limit for receiving said excess.

6. The method of claim 5 where said energy efficient method selects the said non-calling unconditioned and unoccupied said zone that has the largest heat exchange with occupied said zones.

7. The method of claim 5 where said energy efficient method selects the said non-calling unconditioned and unoccupied said zone that has the largest heat exchange with occupied said zones, and if none are found, selects the said non-calling unconditioned and unoccupied said zone that has the largest said heat exchange with said zones receiving said conditioning.

8. The method of claim 5 where said comfort method selects the said non-calling unconditioned and occupied zone that is nearest the condition for making said call.

* * * * *